US005931638A

United States Patent [19]

Krause et al.

[11] Patent Number: 5,931,638

[45] Date of Patent: Aug. 3, 1999

[54] TURBOMACHINERY AIRFOIL WITH OPTIMIZED HEAT TRANSFER

[75] Inventors: David A. Krause, Middletown; Dominic J. Mongillo, Jr., New Britain, both of Conn.; Friedrich O. Soechting, Tequesta, Fla.; Mark F. Zelesky, Coventry, Conn.

[73] Assignee: United Technologies Corporation, Hartford, Conn.

[21] Appl. No.: 08/908,403

[22] Filed: Aug. 7, 1997

[51] Int. Cl.[6] ..... F01D 5/18

[52] U.S. Cl. ..... 416/97 R; 416/96 A; 416/97 A; 415/115

[58] Field of Search ..... 415/115, 116; 416/96 R, 96 A, 97 R, 97 A

[56] References Cited

U.S. PATENT DOCUMENTS

| | | | |
|---|---|---|---|
| 3,240,468 | 3/1966 | Watts et al. | 253/39.15 |
| 3,810,711 | 5/1974 | Emmerson et al. | 416/97 |
| 4,025,226 | 5/1977 | Hovan | 415/115 |
| 4,118,146 | 10/1978 | Dierberger | 416/97 A |
| 4,767,268 | 8/1988 | Auxier et al. | 416/97 R |
| 4,770,608 | 9/1988 | Anderson et al. | 416/97 R |
| 4,775,296 | 10/1988 | Schwarzmann et al. | 416/97 R |
| 5,328,331 | 7/1994 | Bunker et al. | 416/96 R |
| 5,356,265 | 10/1994 | Kercher | 416/97 R |
| 5,392,515 | 2/1995 | Auxier et al. | 29/889.721 |
| 5,403,159 | 4/1995 | Green et al. | 416/97 R |
| 5,405,242 | 4/1995 | Auxier et al. | 415/115 |
| 5,472,316 | 12/1995 | Taslim et al. | 416/96 R |
| 5,498,133 | 3/1996 | Lee | 416/97 R |
| 5,626,462 | 5/1997 | Jackson et al. | 416/97 R |
| 5,669,759 | 9/1997 | Beabout | 416/97 R |
| 5,702,232 | 12/1997 | Moore | 416/95 |
| 5,720,431 | 2/1998 | Sellers et al. | 416/97 R |

*Primary Examiner*—F. Daniel Lopez
*Assistant Examiner*—Richard Woo
*Attorney, Agent, or Firm*—Kenneth C. Baran

[57] ABSTRACT

A blade or vane for a gas turbine engine includes a primary cooling system (42) with a series of medial passages **(44, 46*a*, 46*b*, 46*c*, 48) and an auxiliary cooling system (92) with a series of cooling conduits (94). The conduits of the auxiliary cooling system are parallel to and radially coextensive with the medial passages and are disposed in the peripheral wall (16) of the airfoil between the medial passages and the airfoil external surface (28). The conduits are chordwisely situated in a zone of high heat load (104, 106) so that their effectiveness is optimized. The conduits may also be chordwisely coextensive with some of the medial passages so that coolant in the medial passages is protected from excessive temperature rise. The chordwise dimension C of the conduits is limited so that potentially damaging temperature gradients do not develop in the airfoil wall (16)**.

17 Claims, 4 Drawing Sheets

TURBOMACHINERY AIRFOIL WITH OPTIMIZED HEAT TRANSFER

CROSS REFERENCE TO RELATED APPLICATIONS

This application contains subject matter related to commonly owned copending patent application Ser. No. 07/236,092 now U.S. Pat. No. 5,720,431, entitled "Cooled Blades for a Gas Turbine Engine" filed on Aug. 24, 1988 and commonly owned copending patent application Ser. No. 07/236,093 now U.S. Pat. No. 5,700,131, entitled "Cooled Blades for a Gas Turbine" filed on Aug. 24, 1988.

TECHNICAL FIELD

This invention pertains to coolable turbomachinery components and particularly to a coolable airfoil for a gas turbine engine.

BACKGROUND OF THE INVENTION

The blades and vanes used in the turbine section of a gas turbine engine each have an airfoil section that extends radially across an engine flowpath. During engine operation the turbine blades and vanes are exposed to elevated temperatures that can lead to mechanical failure and corrosion. Therefore, it is common practice to make the blades and vanes from a temperature tolerant alloy and to apply corrosion resistant and thermally insulating coatings to the airfoil and other flowpath exposed surfaces. It is also widespread practice to cool the airfoils by flowing a coolant through the interior of the airfoils.

One well known type of airfoil internal cooling arrangement employs three cooling circuits. A leading edge circuit includes a radially extending impingement cavity connected to a feed channel by a series of radially distributed impingement holes. An array of "showerhead" holes extends from the impingement cavity to the airfoil surface in the vicinity of the airfoil leading edge. Coolant flows radially outwardly through the feed channel to convectively cool the airfoil, and a portion of the coolant flows through the impingement holes and impinges against the forwardmost surface of the impingement cavity. The coolant then flows through the showerhead holes and discharges over the leading edge of the airfoil to form a thermally protective film. A midchord cooling circuit typically comprises a serpentine passage having two or more chordwisely adjacent legs interconnected by an elbow at the radially innermost or radially outermost extremities of the legs. A series of judiciously oriented cooling holes is distributed along the length of the serpentine, each hole extending from the serpentine to the airfoil external surface. Coolant flows through the serpentine to convectively cool the airfoil and discharges through the cooling holes to provide transpiration cooling. Because of the hole orientation, the discharged coolant also forms a thermally protective film over the airfoil surface. Coolant may also be discharged from the serpentine through an aperture at the blade tip and through a chordwisely extending tip passage that guides the coolant out the airfoil trailing edge. A trailing edge cooling circuit includes a radially extending feed passage, a pair of radially extending ribs and a series of radially distributed pedestals. Coolant flows radially into the feed passage and then chordwisely through apertures in the ribs and through slots between the pedestals to convectively cool the trailing edge region of the airfoil.

Each of the above described internal passages—the leading edge feed channel, midchord serpentine passage, tip passage and trailing edge feed passage—usually includes a series of turbulence generators referred to as trip strips. The trip strips extend laterally into each passage, are distributed along the length of the passage, and typically have a height of no more than about 10% of the lateral dimension of the passage. Turbulence induced by the trip strips enhances convective heat transfer into the coolant.

The above described cooling arrangement, and adaptations of it, have been used successfully to protect turbine airfoils from temperature related distress. However as engine designers demand the capability to operate at increasingly higher temperatures to maximize engine performance, traditional cooling arrangements are proving to be inadequate.

One shortcoming of a conventionally cooled airfoil is its possible unsuitability for applications in which the operational temperatures are excessive over only a portion of the airfoil's surface, despite being tolerable on average. Locally excessive temperatures can degrade the mechanical properties of the airfoil and increase its susceptibility to oxidation and corrosion. Moreover, extreme temperature gradients around the periphery of an airfoil can lead to cracking and subsequent mechanical failure.

Another shortcoming is related to the serpentine passage. A serpentine passage makes multiple passes through the airfoil interior. Accordingly, it takes more time for coolant to travel through a serpentine than to travel through a simple radial passage. This increased coolant residence time is usually considered to be beneficial since it provides an extended opportunity for heat to be transferred from the airfoil to the coolant. However the increased residence time and accompanying heat transfer also significantly raise the coolant's temperature as the coolant proceeds through the serpentine, thereby progressively diminishing the coolant's effectiveness as a heat sink. If the engine operational temperatures are high enough, the diminished coolant effectiveness can offset the benefits of lengthy coolant residence time.

A third shortcoming is related to the desirability of maintaining a high coolant flow velocity, and therefore a high Reynolds Number, in internal cooling passages perforated by a series of coolant discharge holes. The accumulative discharge of coolant through the holes is accompanied by a reduction in the velocity and Reynolds Number of the coolant stream and a corresponding reduction in convective heat transfer into the stream. The reduction in Reynolds Number and heat transfer effectiveness can be mitigated if the cross sectional flow area of the passage is made progressively smaller in the direction of coolant flow. However a reduction in the passage flow area also increases the distance between the perimeter of the passage and the airfoil surface, thereby inhibiting heat transfer and possibly neutralizing any benefit attributable to the area reduction.

A fourth shortcoming affects the airfoils of blades, but not those of vanes. Blades extend radially outwardly from a rotatable turbine hub and, unlike vanes, rotate about the engine's longitudinal centerline during engine operation. The rotary motion of the blade urges the coolant flowing through any of the radially extending passages to accumulate against one of the surfaces (the advancing surface) that bounds the passage. This results in a thin boundary layer that promotes good heat transfer. However this rotational effect also causes the coolant to become partially disassociated from the laterally opposite passage surface (the receding surface) resulting in a correspondingly thick boundary layer that impairs effective heat transfer. Unfortunately the receding passage surface may be proximate to a portion of the airfoil that is subjected to the highest temperatures and therefore requires the most potent heat transfer.

It may be possible to enhance the heat transfer effectiveness in a conventional airfoil by providing a greater quantity of coolant or by using coolant having a lower temperature. In a gas turbine engine, the only reasonably available coolant is compressed air extracted from the engine compressors. Since the diversion of compressed air from the compressors degrades engine efficiency and fuel economy, extraction of additional compressed air to compensate for ineffective airfoil heat transfer is undesirable. The use of lower temperature air is usually unfeasible since the pressure of the lower temperature air is insufficient to ensure positive coolant flow through the turbine airfoil passages.

Improved heat transfer can also be realized by employing trip strips whose height is greater than 10% of the passage lateral dimension. However this approach is unattractive for rotating blades since the trip strips are numerous and the aggregate weight arising from the use of enlarged trip strips unacceptably amplifies the rotational stresses imposed on the turbine hub.

SUMMARY OF THE INVENTION

It is, therefore, a primary object of the invention to provide a coolable airfoil for a turbine blade or vane that requires a minimum of coolant but is nevertheless capable of long duration service at high temperatures.

It is a further object of the invention to provide a coolable airfoil whose heat transfer features are customized to the temperature distribution over the airfoil surface.

It is another object of the invention to provide a coolable airfoil that enjoys the heat absorption benefits of a serpentine cooling passage without experiencing excessive coolant temperature rise.

It is an additional object of the invention to provide a coolable airfoil whose coolant passages diminish in cross sectional area to maintain a high Reynolds Number in the coolant stream, but without inhibiting heat transfer due to increased distance between the perimeter of the passage and the airfoil surface.

It is still another object of the invention to provide a coolable airfoil having features that compensate for locally impaired heat transfer arising from rotational effects.

According to the invention, a coolable airfoil has an auxiliary cooling system that supplements a primary cooling system by absorbing excess heat in a predetermined zone of high heat load.

According to one aspect of the invention, a coolable airfoil includes a primary cooling system comprising one or more medial passages bounded in part by a peripheral wall of the airfoil, and an auxiliary cooling system comprising one or more cooling conduits disposed in the peripheral wall and chordwisely situated in a zone of high heat load.

According to another aspect of the invention, the primary cooling system includes an array of medial passages, at least two of which are interconnected to form a serpentine passage, and the auxiliary conduits are chordwisely coextensive with at least one of the medial passages to thermally insulate coolant flowing through the medial passage.

According to still another aspect of the invention, the chordwise dimension of the auxiliary conduits is no more than a predetermined multiple of the distance from the conduits to the external surface of the airfoil so that thermal stresses arising from the presence of the conduits are minimized.

In one embodiment of the invention, the auxiliary cooling system comprises at least two auxiliary conduits with a radially extending interrupted rib separating chordwisely adjacent conduits.

In another embodiment of the invention, an array of trip strips extends laterally from a portion of the perimeter surface of the conduits to a height that exceeds about 20% of the conduit lateral dimension and is preferably about 50% of the conduit lateral dimension.

The airfoil of the present invention is advantageous in that it can withstand sustained operation at elevated temperatures without suffering thermally induced damage or consuming inordinate quantities of coolant. More specifically, the airfoil is suitable for use in an environment where the temperature distribution over the airfoil's external surface is spatially nonuniform. Additional specific advantages include the airfoil's decreased susceptibility to the loss of coolant effectiveness that customarily arises from factors such as lengthy coolant residence time, progressively diminishing coolant stream Reynolds Number, and adverse rotational effects.

The foregoing features and advantages and the operation of the invention will become more apparent in light of the following description of the best mode for carrying out the invention and the accompanying drawings.

BEST MODE FOR CARRYING OUT THE INVENTION

Figure 1:
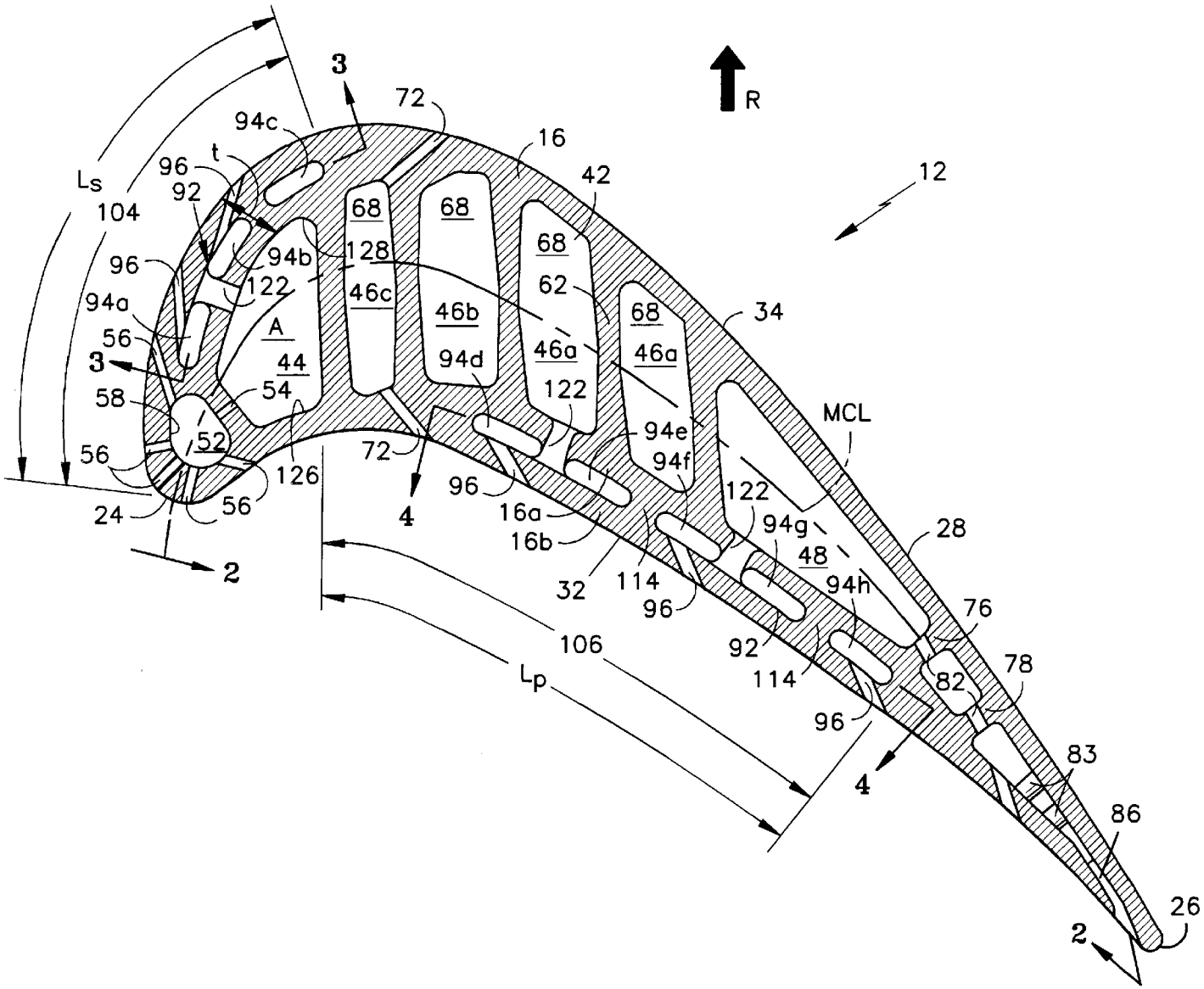
FIG. 1 is a cross sectional view of a coolable airfoil having a primary cooling system and a secondary cooling system according to the present invention.

Referring to FIGS. 1–4 a coolable turbine blade 10 for a gas turbine engine has an airfoil section 12 that extends radially across an engine flowpath 14. A peripheral wall 16 extends radially from the root 18 to the tip 22 of the airfoil 12 and chordwisely from a leading edge 24 to a trailing edge 26. The peripheral wall 16 has an external surface 28 that includes a concave or pressure surface 32 and a convex or suction surface 34 laterally spaced from the pressure surface. A mean camber line MCL extends chordwisely from the leading edge to the trailing edge midway between the pressure and suction surfaces.

The illustrated blade is one of numerous blades that project radially outwardly from a rotatable turbine hub (not shown). During engine operation, hot combustion gases 36 originating in the engine's combustion chamber (also not shown) flow through the flowpath causing the blades and hub to rotate in direction R about an engine longitudinal axis 38. The temperature of these gases is spatially nonuniform, therefore the airfoil 12 is subjected to a nonuniform temperature distribution over its external surface 28. In addition, the depth of the aerodynamic boundary layer that envelops the external surface varies in the chordwise direction. Since both the temperature distribution and the boundary layer depth influence the rate of heat transfer from the hot gases into the blade, the peripheral wall is exposed to a chordwisely varying heat load along both the pressure and suction surfaces. In particular, a zone of high heat load is present from about 0% to 20% of the chordwise distance from the leading edge to the trailing edge along the suction surface, and from about 10% to 75% of the chordwise distance from the leading edge to the trailing edge along the pressure surface. Although the average temperature of the combustion gases may be well within the operational capability of the airfoil, the heat transfer into the blade in the high heat load zone can cause localized mechanical distress and accelerated oxidation and corrosion.

The blade has a primary cooling system 42 comprising one or more radially extending medial passages 44, 46*a*, 46*b*, 46*c* and 48 bounded at least in part by the peripheral wall 16. Near the leading edge of the airfoil, feed passage 44 is in communication with impingement cavity 52 through a series of radially distributed impingement holes 54. An array of "showerhead" holes 56 extends from the impingement cavity to the airfoil surface 28 in the vicinity of the airfoil leading edge. Coolant $C_{LE}$ flows radially outwardly through the feed passage and through the impingement cavity to convectively cool the airfoil, and a portion of the coolant flows through the impingement holes 54 and impinges against the forwardmost surface 58 of the impingement cavity to impingement cool the surface 58. The coolant then flows through the showerhead holes and discharges as a thermally protective film over the leading edge of the airfoil. The cross sectional area A of the feed passage diminishes with increasing radius (i.e. from the root to the tip) so that the Reynolds Number of the coolant stream remains high enough to promote good heat transfer despite the discharge of coolant through the showerhead holes.

Midchord medial passages 46*a*, 46*b* and 46*c* cool the midchord region of the airfoil. Passage 46*a*, which is bifurcated by a radially extending rib 62, and chordwisely adjacent passage 46*b* are interconnected by an elbow 64 at their radially outermost extremities. Chordwisely adjacent passages 46*b* and 46*c* are similarly interconnected at their radially innermost extremities by elbow 66. Thus, each of the medial passages 46*a*, 46*b* and 46*c* is a leg of a serpentine passage 68. Judiciously oriented cooling holes 72 are distributed along the length of the serpentine, each hole extending from the serpentine to the airfoil external surface. Coolant $C_{MC}$ flows through the serpentine to convectively cool the airfoil and discharges through the cooling holes to transpiration cool the airfoil. The discharged coolant also forms a thermally protective film over the pressure and suction surfaces 32, 34. A portion of the coolant that reaches the outermost extremity of passage 46*a* is discharged through a chordwisely extending tip passage 74 that guides the coolant out the airfoil trailing edge.

Trailing edge feed passage 48 is chordwisely bounded by trailing edge cooling features including ribs 76, 78, each perforated by a series of apertures 82, a matrix of posts 83 separated by spaces 84, and an array of pedestals 85 defining a series of slots 86. Coolant $C_{TE}$ flows radially into the feed passage and chordwisely through the apertures, spaces and slots to convectively cool the trailing edge region.

An auxiliary cooling system 92 includes one or more radially continuous conduits, 94*a*–94*h* (collectively designated 94), substantially parallel to and radially coextensive with the medial passages. Each conduit includes a series of radially spaced film cooling holes 96 and a series of exhaust vents 98. The conduits are disposed in the peripheral wall 16 laterally between the medial passages and the airfoil external surface 28, and are chordwisely situated within the zone of high heat load, i.e. within the sub-zones 104, 106 extending respectively from about 0% to 20% of the chordwise distance from the leading edge to the trailing edge along the suction surface 34 and from about 10% to 75% of the chordwise distance from the leading edge to the trailing edge along the pressure surface 32. Coolant $C_{PS}$, $C_{SS}$ flows through the conduits thereby promoting more heat transfer from the peripheral wall than would be possible with the medial passages alone. A portion of the coolant discharges into the flowpath by way of the film cooling holes 96 to transpiration cool the airfoil and establish a thermally protective film along the external surface 28. Coolant that reaches the end of a conduit exhausts into the flowpath through exhaust vents 98.

The conduits 94 are substantially chordwisely coextensive with at least one of the medial passages so that coolant $C_{PS}$ and $C_{SS}$ absorbs heat from the peripheral wall 16 thereby thermally shielding or insulating the coolant in the chordwisely coextensive medial passages. In the illustrated embodiment, conduits 94*d*–94*h* along the pressure surface 32 are chordwisely coextensive with both the trailing edge feed passage 48 and with legs 46*a* and 46*b* of the serpentine passage 68. The chordwise coextensivity between the conduits and the trailing edge feed passage helps to reduce heat transfer into coolant $C_{TE}$ in the feed passage 48. This, in turn, preserves the heat absorption capacity of coolant $C_{TE}$ thereby enhancing its ability to convectively cool the trailing edge region as it flows through the apertures 82, spaces 84 and slots 86. Similarly, the chordwise coextensivity between the conduits and legs 46*a*, 46*b* of the serpentine passage 68 helps to minimize the temperature rise of coolant $C_{MC}$ during the coolant's lengthy residence time in the serpentine passage. As a result, coolant $C_{MC}$ retains its effectiveness as a heat transfer medium and is better able to cool the airfoil as it flows through serpentine leg 46*c* and tip passage 74. Consequently, the benefits of lengthy coolant residence time are not offset by excessive coolant temperature rise as the coolant progresses through the serpentine.

The auxiliary conduits are chordwisely distributed over substantially the entire length, $L_S+L_P$, of the high heat load zone, except for the small portion of sub-zone 104 occupied by the impingement cavity 52 and showerhead holes 56 and a small portion of sub-zone 106 in the vicinity of serpentine leg 46*c*. However the conduits may be distributed over less than the entire length of the high heat load zone. For example, auxiliary conduits may be distributed over substantially the entire length $L_S$ of the suction surface sub-zone 104, but may be absent in the pressure surface sub-zone 106. Conversely, conduits may be distributed over substantially the entire length $L_P$ of the pressure surface sub-zone 106 but may be absent in the suction surface sub-zone 104. Moreover, conduits may be distributed over only a portion of either or both of the subzones. The extent to which the conduits of the auxiliary cooling system are present or absent is governed by a number of factors including the local intensity of the heat load and the desirability of mitigating the rise of coolant temperature in one or more of the medial passages. In addition, it is advisable to weigh the desirability of the conduits against any additional manufacturing expense arising from their presence.

Figure 1A:
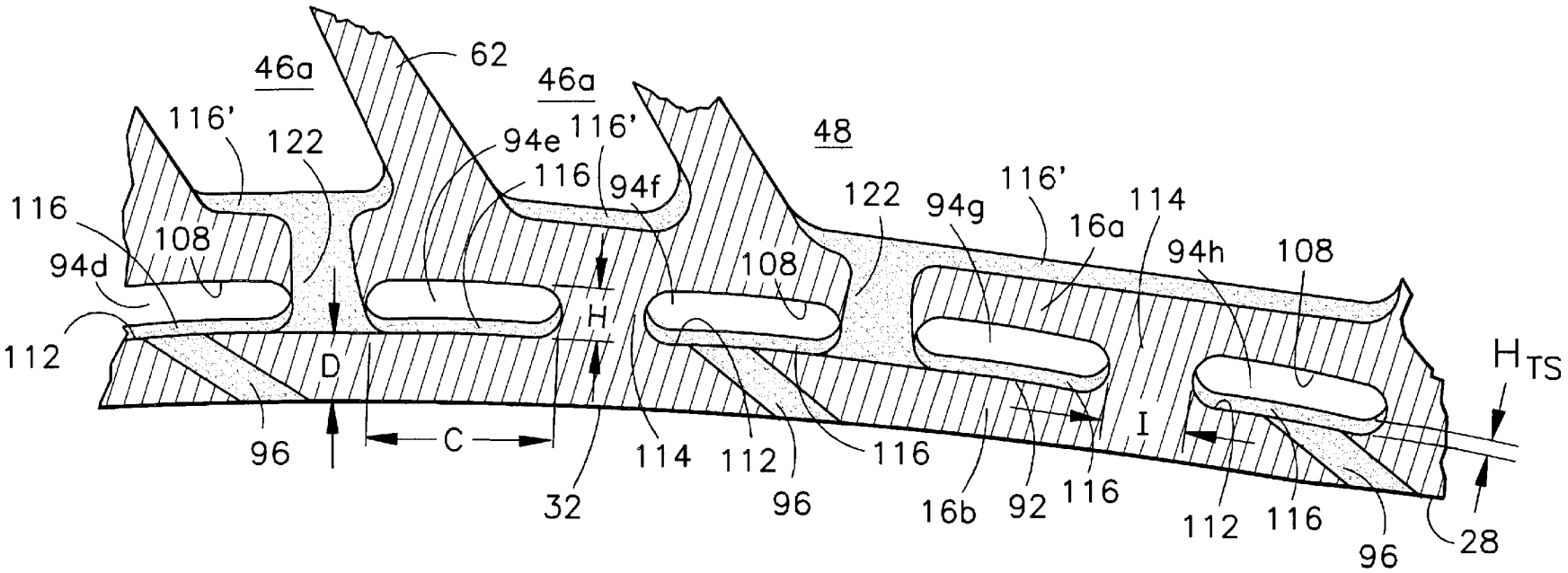
FIG. 1A is an enlarged cross sectional view of a portion of the airfoil shown in FIG. 1.
Figure 2:
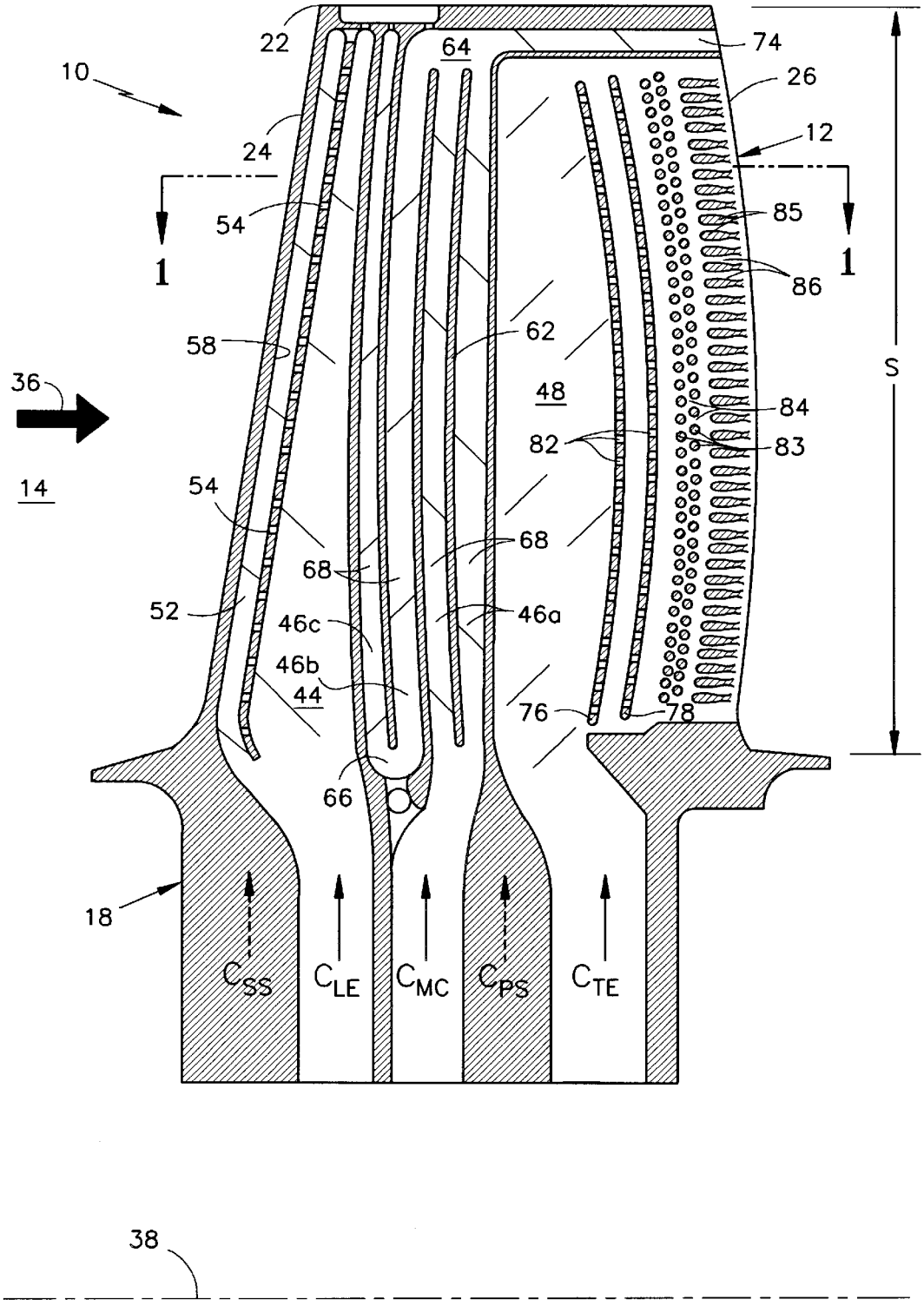
FIG. 2 is a view taken substantially in the direction 2—2 of FIG. 1 showing a series of medial coolant passages that comprise the primary cooling system.

Referring primarily to FIG. 1A, Each auxiliary conduit 94 has a lateral dimension H and a chordwise dimension C and is bounded by a perimeter surface 108, a portion 112 of which is proximate to the external surface 28. The chordwise dimension exceeds the lateral dimension so that the cooling benefits of each individual conduit extend chordwisely as far as possible. The chordwise dimension is constrained, however, because each conduit divides the peripheral wall into a relatively cool inner portion 16*a* and a relatively hot outer portion 16*b*. If a conduit's chordwise dimension is too long, the temperature difference between the two wall portions 16*a*, 16*b* may cause thermally induced cracking of the airfoil. Therefore the chordwise dimension of each conduit is limited to no more than about two and one half to three times the lateral distance D from the proximate perimeter surface 112 to the external surface 28. Adjacent conduits, such as those in the illustrated embodiment, are separated by radially extending ribs 114 so that the inter-conduit distance I is at least about equal to lateral distance D. The inter-conduit ribs ensure sufficient heat transfer from wall portion 16*a* to wall portion 16*b* to attenuate the temperature difference and minimize the potential for cracking.

Each inter-conduit rib 114 is interrupted along its radial length so that coolant can flow through interstices 124 to bypass any obstruction or constriction that may be present in a conduit. Obstructions and constrictions may arise from manufacturing impression or may be in the form of particulates that are carried by the coolant and become lodged in a conduit.

Figure 4A:
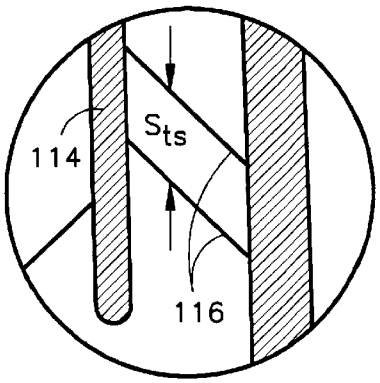
FIG. 4 is a view taken substantially in the direction 4—4 of FIG. 1 showing a series of cooling conduits that comprise the secondary cooling system along the concave side of the airfoil.
Figure 4:
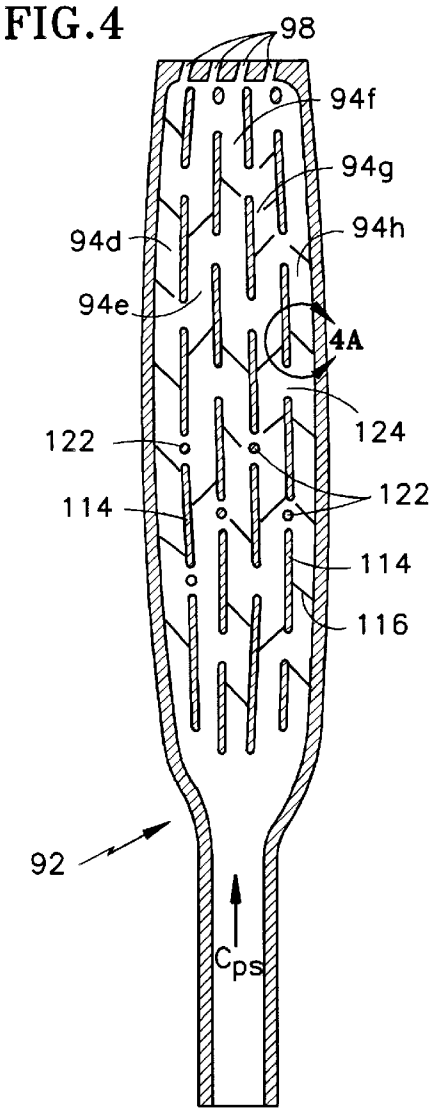
Figure 3:
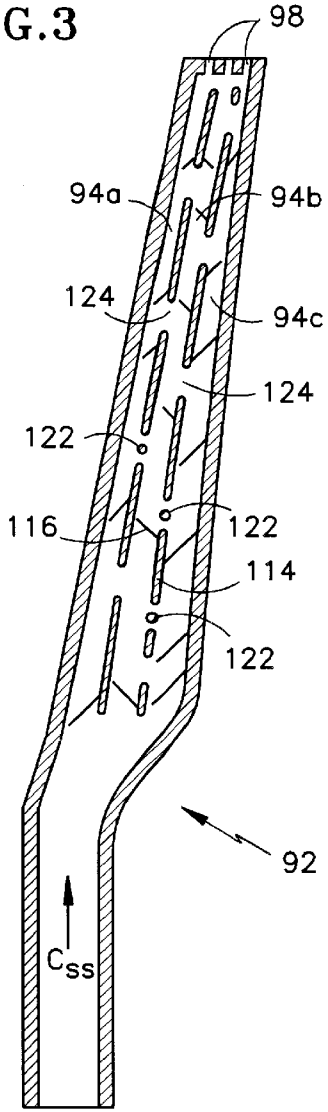
FIG. 3 is a view taken substantially in the direction 3—3 of FIG. 1 showing a series of cooling conduits that comprise the secondary cooling system along the convex side of the airfoil.

An array of trip strips 116 (only a few of which are shown in FIGS. 3 and 4 to preserve the clarity of the illustrations) extends laterally from the proximate surface 112 of each conduit. Because the conduit lateral dimension H is small relative to the lateral dimension of the medial passages, the conduit trip strips can be proportionately larger than the trip strips 116' employed in the medial passages without contributing inordinately to the weight of the airfoil. The lateral dimension or height $H_{TS}$ of the conduit trip strips exceeds 20% of the conduit lateral dimension H, and preferably is about 50% of the conduit lateral dimension. The trip strips are distributed so that the radial separation $s_{ts}$ (FIG. 4) between adjacent trip strips is between five and ten times the lateral dimension (e.g. $H_{TS}$) of the trip strips and preferably between five and seven times the lateral dimension. This trip strip density maximizes the heat transfer effectiveness of the trip strip array without imposing undue pressure loss on the stream of coolant.

The airfoil may also include a set of radially distributed coolant replenishment passageways 122, each extending from a medial passage (e.g. passage 44, 46*a* and 48) to the auxiliary cooling system. Coolant from the medial passage flows through the passageways 122 to replenish coolant that is discharged from the conduits through the film cooling holes 96. The replenishment passageways are situated between about 15% and 40% of the airfoil span S (i.e. the radial distance from the root to the tip) but may be distributed along substantially the entire span if necessary. The quantity and distribution of replenishment passageways depends in part on the severity of the pressure loss experienced by coolant flowing radially through the conduit or conduits being replenished. If the conduit imposes a high pressure loss, a disproportionately large fraction of the coolant will discharge through the film cooling holes rather than proceed radially outwardly through the conduit. As a result, a large quantity of passageways will be necessary to replenish the discharged coolant. However, it is undesirable to have too many passageways since coolant introduced into a conduit by way of a replenishment passageway diverts coolant already flowing through the conduit and encourages that coolant to discharge through film cooling holes upstream (i.e. radially inwardly) of the passageway. If the diverted coolant still has a significant amount of unexploited heat absorption capability, then the coolant is being used ineffectively, and engine efficiency will be unnecessarily degraded.

The replenishment passageways 122 are aligned with the interstices 124 distributed along the inter-conduit ribs 114 rather than with the conduits themselves. This alignment is advantageous since the replenishment coolant is expelled from the passageway as a high velocity jet of fluid. The fluid jet, if expelled directly into a conduit, could impede the radial flow of coolant through the conduit thereby interfering with effective heat transfer into the coolant.

During engine operation, coolant flows into and through the medial passages and auxiliary conduits as described above to cool the blade peripheral wall 16. Because the conduits are situated exclusively within the high heat load zone, rather than being distributed indiscriminately around the entire periphery of the airfoil, the benefit of the conduits can be concentrated wherever the demand for aggressive heat transfer is the greatest. Discriminate distribution of the conduits also facilitates selective shielding of coolant in the medial passages, thereby preserving the coolant's heat absorption capacity for use in other parts of the cooling circuit. Such sparing use of the conduits also helps minimize manufacturing costs since an airfoil having the small auxiliary conduits is more costly to manufacture than an airfoil having only the much larger medial passages. The small size of the conduits also permits the use of trip strips whose height, in proportion to the conduit lateral dimension, is sufficient to promote excellent heat transfer.

The cooling conduits also ameliorate the problem of diminished coolant stream Reynold's Number due to the discharge of coolant along the length of a medial passage. For example, the presence of suction surface conduits 94*a*, 94*b*, 94*c* allow the peripheral wall thickness t (FIG. 1) between leading edge feed passage 44 and airfoil suction surface 34 to be greater than the corresponding thickness in a prior art airfoil. As a result, the radial reduction in flow area A of the leading edge feed passage 44 is proportionally greater in the present airfoil than in a similar leading edge feed channel in a prior art airfoil. Consequently, high coolant stream Reynold's Number and corresponding high heat transfer rates can be realized along the entire length of passage 44 despite the discharge of coolant through showerhead holes 56 and film cooling holes 96. Moreover, the suction surface conduits 94*a*, 94*b*, 94*c* compensate for any loss of heat transfer from the peripheral wall attributable to the increased thickness t.

The invention also helps to counteract the impaired heat transfer arising from rotational effects in turbine blades. During engine operation, a blade having an airfoil as shown in FIG. 1 rotates in direction R about the engine centerline 38. Coolant flowing radially outwardly, for example through leading edge feed passage 44, therefore tends to be urged against advancing surface 126 while also becoming partially disassociated from receding surface 128. The disassociative influence promotes the development of a thick aerodynamic boundary layer and concomitantly poor heat transfer along the receding surface. The presence of conduits 94*a*, 94*b*, 94*c* compensates for this adverse rotational effect. A similar compensatory effect could, if desired, be obtained adjacent to the midchord and trailing edge passages 46*a*, 46*b*, 46*c* and 48. However the coolant in these passages is subjected to a lower heat load than the coolant in passage 44 and is adequately protected by the cooling film dispersed by film cooling holes 72.

Various changes and modifications can be made without departing from the invention as set forth in the accompanying claims. For example, although the midchord medial passages are shown as being interconnected to form a serpentine, the invention also embraces an airfoil having independent or substantially independent midchord medial passages. In addition, individual designations have been assigned to the coolant supplied to the passages and conduits since each passage and conduit may each be supplied from its own dedicated source of coolant. In practice, however, a common coolant source may be used to supply more than one, or even all of the passages and conduits. A common coolant source for all the passages and conduits is, in fact, envisioned as the preferred embodiment.

We claim:

1. A coolable airfoil, comprising:

a peripheral wall having an external surface comprised of a suction surface and a pressure surface laterally spaced from the suction surface, the surfaces extending chordwisely from a leading edge to a trailing edge and radially from an airfoil root to an airfoil tip;

a primary cooling system comprised of at least one radially extending medial passage bounded at least in part by the peripheral wall; and an auxiliary cooling system comprised of at least one cooling conduit substantially parallel to and radially coextensive with the medial passage, the conduit disposed in the wall between the medial passage and the external surface and chordwisely situated exclusively within a zone of high heat load, the high heat load zone being from about 0% to 20% of the chordwise distance from the leading edge to the trailing edge along the suction surface and about 10% to 75% of the chordwise distance from the leading edge to the trailing edge along the pressure surface, the airfoil wall chordwisely outside the high heat load zone being devoid of the cooling conduits.

2. A coolable airfoil, comprising:

a peripheral wall having an external surface comprised of a suction surface and a pressure surface laterally spaced from the suction surface, the surfaces extending chordwisely from a leading edge to a trailing edge and radially from an airfoil root to an airfoil tip;

a primary cooling system comprised of chordwisely adjacent radially extending medial passages, at least two of the medial passages being interconnected to form a cooling serpentine; and an auxiliary cooling system comprised of at least one cooling conduit substantially parallel to and radially coextensive with the medial passages, the conduit disposed in the wall between the medial passages and the external surface, the conduit being chordwisely coextensive with at least one of the interconnected medial passages so that coolant flowing through the conduit absorbs heat from the peripheral wall thereby thermally insulating coolant flowing through the at least one medial passage.

3. A coolable airfoil, comprising:

a peripheral wall having an external surface comprised of a suction surface and a pressure surface laterally spaced from the suction surface, the surfaces extending chordwisely from a leading edge to a trailing edge and radially from an airfoil root to an airfoil tip;

a primary cooling system comprised of at least one radially extending medial passage bounded at least in part by the peripheral wall; and an auxiliary cooling system comprised of at least one cooling conduit substantially parallel to and radially coextensive with the medial passage, the conduit disposed in the wall between the medial passage and the external surface, the conduit having a chordwise dimension and a lateral dimension, the chordwise dimension being no more than about three times the distance from the conduit to the external surface.

4. The coolable airfoil of claim 1, wherein the primary cooling system comprises an array of chordwisely adjacent radially extending medial passages, at least two of the medial passages being interconnected to form a cooling serpentine, the conduits being chordwisely coextensive with at least one of the interconnected medial passages.

5. The coolable airfoil of claim 1, wherein the conduits have a chordwise dimension and a lateral dimension, the chordwise dimension being no more than about three times the distance from the conduit to the external surface.

6. The coolable airfoil of claim 1, wherein the primary cooling system comprises an array of chordwisely adjacent radially extending medial passages, at least two of the medial passages being interconnected to form a cooling serpentine, the conduits being chordwisely coextensive with at least one of the interconnected medial passages, and wherein the conduit has a chordwise dimension and a lateral dimension, the chordwise dimension of each conduit being no more than about three times the distance from the conduit to the external surface.

7. The coolable airfoil of claim 2, wherein the conduit has a chordwise dimension and a lateral dimension, the chordwise dimension being no more than about three times the distance from the conduit to the external surface.

8. The coolable airfoil of claim 1, wherein the cooling conduits are chordwisely distributed over substantially the entire high heat load zone.

9. The coolable airfoil of claim 1, wherein the cooling conduits are chordwisely distributed over substantially the entire high heat load zone along the pressure surface of the airfoil.

10. The coolable airfoil of claim 1 wherein the cooling conduits are chordwisely distributed over substantially the entire high heat load zone along the suction surface of the airfoil.

11. The coolable airfoil of claim 1, 2 or 3 wherein chordwisely adjacent cooling conduits are separated by a radially extending rib interrupted by at least one interstice.

12. The coolable airfoil of claim 11 comprising one or more radially distributed replenishment passageways extending from a medial passage to the auxiliary cooling system, the passageways being aligned with the interstices.

13. The coolable airfoil of claim 1, 2 or 3 wherein each conduit has a lateral dimension and a chordwise dimension that exceeds the lateral dimension.

14. The coolable airfoil of claim 1, 2 or 3 wherein the conduits each have a lateral dimension and a chordwise dimension and are each bounded by a perimeter surface, a portion of the perimeter surface being proximate the external surface, the proximate portion having an array of trip strips extending laterally therefrom, the trip strips having a height that exceeds about 20% of the conduit lateral dimension.

15. The coolable airfoil of claim 14 wherein the trip strips are spaced apart by a radial separation and the ratio of the radial separation to the trip strip height is between about five and ten.

16. The coolable airfoil of claim 14 wherein the trip strips have a height of about 50% of the lateral dimension.

17. The coolable airfoil of claim 15 wherein the ratio of the radial separation to the trip strip height is between about five and seven.

* * * * *